US007111598B2

(12) United States Patent
Gaubatz et al.

(10) Patent No.: US 7,111,598 B2
(45) Date of Patent: Sep. 26, 2006

(54) PIVOTING ACTUATOR SYSTEM FOR CONTROLLING THE STROKE OF A GAS EXCHANGE VALVE IN THE CYLINDER HEAD OF AN INTERNAL COMBUSTION ENGINE

(75) Inventors: Karl-Heinz Gaubatz, Parsdorf (DE); Johannes Meyer, Karlsfeld (DE); Axel Knaut, Munich (DE); Rudolf Seethaler, Munich (DE)

(73) Assignee: Bayerische Motoren Werke AG, Munich (DE)

( * ) Notice: Subject to any disclaimer, the term of this patent is extended or adjusted under 35 U.S.C. 154(b) by 0 days.

(21) Appl. No.: 11/128,185

(22) Filed: May 13, 2005

(65) Prior Publication Data

US 2006/0016408 A1 Jan. 26, 2006

Related U.S. Application Data

(63) Continuation of application No. PCT/EP03/11409, filed on Oct. 15, 2003.

(30) Foreign Application Priority Data

Nov. 14, 2002 (DE) ..... 102 52 991

(51) Int. Cl.
*F01L 1/34* (2006.01)

(52) U.S. Cl. ..... 123/90.16; 123/90.15; 123/90.11; 123/90.31; 123/90.6; 74/569; 74/567

(58) Field of Classification Search ..... 123/90.16, 123/90.15, 90.11, 90.17, 90.31, 90.6; 74/569, 74/567

See application file for complete search history.

(56) References Cited

U.S. PATENT DOCUMENTS

| | | | | |
|---|---|---|---|---|
| 3,261,338 | A | 7/1966 | Arutunoff et al. | |
| 4,723,516 | A * | 2/1988 | Slagley et al. | 123/90.16 |
| 5,253,546 | A * | 10/1993 | Elrod et al. | 74/567 |
| 5,331,931 | A * | 7/1994 | Blish et al. | 123/90.11 |
| 5,873,335 | A | 2/1999 | Wright et al. | |
| 6,553,952 | B1 * | 4/2003 | Grau | 123/90.17 |

FOREIGN PATENT DOCUMENTS

| | | |
|---|---|---|
| EP | 1 039 103 A2 | 3/2000 |
| WO | WO 03/016683 A1 | 2/2003 |

OTHER PUBLICATIONS

German Search Report, Nov. 14, 2002.
International Search Report, Dec. 15, 2003.

* cited by examiner

*Primary Examiner*—Thomas Denion
*Assistant Examiner*—Zelalem Eshete
(74) *Attorney, Agent, or Firm*—Crowell & Moring LLP

(57) ABSTRACT

Swivel actuator device for lift control of a gas exchange valve in a cylinder head of an internal combustion engine comprising a swivel motor having a shaft on which is provided a first operating element having a control path for opening the gas exchange valve, whereby a second operating element having a second control path provided on the first operating element. Due to the arrangement of the swivel actuator device, less electric power is needed at low rotational speeds and processing of the fuel mixture is improved.

12 Claims, 1 Drawing Sheet

PIVOTING ACTUATOR SYSTEM FOR CONTROLLING THE STROKE OF A GAS EXCHANGE VALVE IN THE CYLINDER HEAD OF AN INTERNAL COMBUSTION ENGINE

This application is a continuation of International Patent Application No. PCT/EP02/07998, filed Jul. 18, 2002, the entire disclosure of which is incorporated herein by reference. Priority is claimed based on German Patent Application No. 101 40 461.1, filed Aug. 17, 2001.

BACKGROUND AND SUMMARY OF THE INVENTION

The invention relates to a swivel actuator device for lift control of a gas exchange valve in a cylinder head of an internal combustion engine.

Currently unpublished German Patent Application 101 40 461 describes a rotary actuator device for lift control of a gas exchange valve in a cylinder head of an internal combustion engine. The lift is controlled via an electric motor driven by engine characteristics maps; the rotor of this motor has a shaft with a control cam in a rotationally fixed connection. During operation of the internal combustion engine, the motor swivels and/or swings back and forth and the control cam periodically presses the gas exchange valve into its open position via a swivel lever. The gas exchange valve is closed by the spring force of a valve spring. An additional spring is mounted on the shaft in order for the electric motor not to have to overcome the total spring force of the valve spring in opening the gas exchange valve. The forces of the valve spring and the additional spring are such that in periodic operation of the rotary actuator device, the kinetic energy is stored either in the valve spring or in the additional spring, depending on the position of the gas exchange valve. As a result of this measure, the power consumption in operation of the rotary actuator device is reduced. The control cam is alternately controlled by the electric motor and has a single cam flank designed with a ramp serving for opening and closing between a cam cup and a base circuit; in a diametric area, the control cam has a base circle section that is lengthened in the circumferential direction for this cam flank, a stop face for a first rotational stop on the motor side or on the cylinder head side following this base circle section and being directed essentially radially to the cam cup region.

One disadvantage of the rotary actuator device described here is the high power consumption at low rotational speeds.

The object of the present invention is to reduce power consumption at low rotational speeds for a generic rotary actuator device.

This object is achieved by providing a second operating element having a first control path, situated on the first operating element. This invention expands the existing swivel actuator device through a second contrarotating operating element with a smaller lift in comparison with the main cam. This second operating element does not open the valve completely and is used only for small lifts in the range of low engine rotational speeds. At low rotational speeds of the internal combustion engine, the swivel actuator device receives electric current so that the shaft swivels only in the direction of the second operating element, whereas at high rotational speeds it is swiveled only in the direction of the first operating element. Due to the smaller lift, the swivel actuator device advantageously consumes less current at low rotational speeds.

In further embodiments, the two operating elements form a double cam which can be operated smoothly in two directions. In addition, it is simple and inexpensive to manufacture a double control path designed in this way, such that its zero lift ranges are next to one another.

With embodiments providing less than full lift, the power consumption is low at low rotational speeds. Furthermore, valve noise generated by the gas exchange valve striking the valve seat is reduced by the inventive design. The second operating element equalizes the torques of the spring element, an actuator spring, against the torques of the valve spring. The resulting torque on the camshaft is almost zero, depending on tolerances, and thus the camshaft can be kept almost currentless in any angular position of the second operating element. Such a system has low dynamics because it is built up merely by the torque buildup by the slewing motor (through electric power supply). Another advantage that can be mentioned is the improvement in the gas dynamics in load exchange because supersonic speeds can be generated in the valve gap due to the small valve lift, which thus makes a significant positive contribution toward good processing of the fuel mixture. In one embodiment in particular, system overshooting does not have any effect because the valve lift cannot be altered in these ranges.

To improve the low dynamics of the second operating element, the second control path may be divided into acceleration and deceleration. To do so, the control path is divided into two ranges. In the first lift range, above zero lift or a defined value (from 0.6 mm to 1.5 mm lift), the kinematic torque of the spring element is compensated only to a slight extent so that a spring-induced acceleration is impressed upon the swivel actuator device. In the second lift range (e.g., from 1.5 mm to approx. 3.5 mm), the kinematic torque of the spring element is overcompensated, so that a spring-induced deceleration is imposed upon the swivel actuator device over this lift range. Due to this design, it is possible in a simple way to have a positive influence on the dynamics of the swivel actuator device, especially at low valve lifts.

It is possible to arrange the two operating elements either radially on the outside circumference of the shaft, so that multiple gas exchange valves can be operated by one swivel actuator device, and/or apply a rocker arm path to the end face of the shaft so that a single gas exchange valve can be controlled with it.

The internal friction of the system is reduced with the arrangement of a power transmission element between the operating element and the gas exchange valve.

The inventive swivel actuator device according to patent Claim 12 may be arranged advantageously on the intake and/or exhaust ends of the cylinder head of the internal combustion engine. This principle of equal parts permits inexpensive production.

Other objects, advantages and novel features of the present invention will become apparent from the following detailed description of the invention when considered in conjunction with the accompanying drawings.

DETAILED DESCRIPTION

Figure 1:
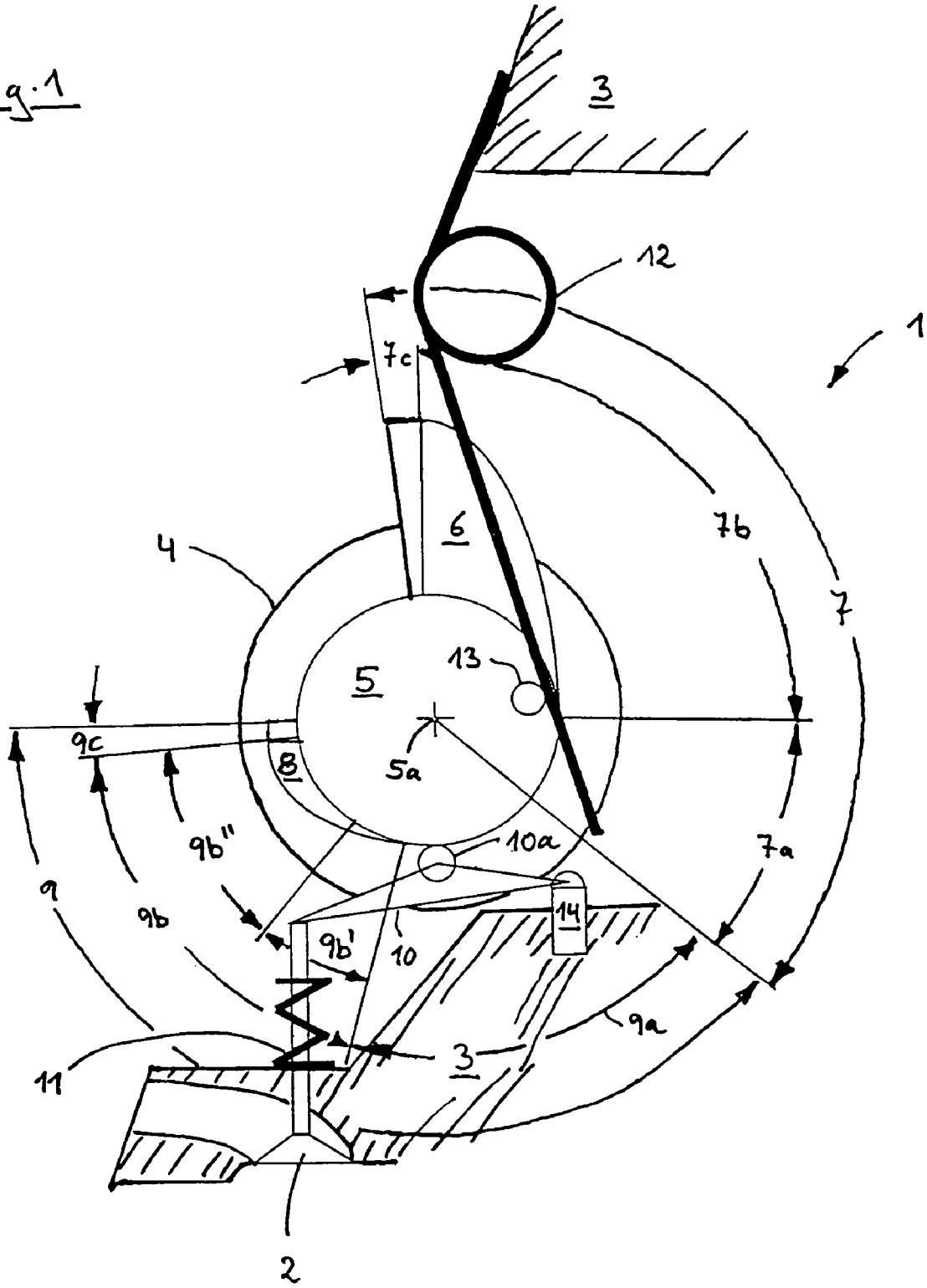
FIG. 1 is a schematic view in an axial direction of a swivel actuator device in accordance with an embodiment of the present invention.

FIG. 1 shows a schematic diagram of an inventive swivel actuator device 1 in the installed position in a cylinder head 3. The swivel actuator device 1 consists essentially of a swivel motor 4 with a stator (not shown) and a rotor (not shown). The rotor is connected to the shaft 5 with a common axis of rotation 5*a* in a stationary location. The shaft 5 has an operating element 6 radially on its circumference with a control path 7, a half cam. The control path 7 is divided into three individual ranges, a zero lift range 7*a*, a lift range 7*b* and a full lift range 7*c*. A second operating element 8 with a second control path 9 follows the zero lift range 7*a* in the opposite direction of rotation. The second control path 9 is also divided into three ranges, a second zero lift range 9*a*, a second lift range 9*b* and a partial lift range 9*c*. The second lift range 9*b* is in turn subdivided into an acceleration lift range 9*b*', which follows the second zero lift range 9*a*, which is in turn followed by a deceleration lift range 9*b*". The first zero lift range 7*a* and the second zero lift range 9*a* adjacent thereto have the same constant radius R1, based on the axis of rotation 5*a*. This distance of the control path 7 in the lift range 7*b* increases in the direction of the full lift range 7*c* over an angle of rotation according to a cam contour. The full lift range 7*c* following the lift range 7*b* in turn has a constant radius R2. The difference in radius between R2 and R1 is equal to a height $h_1$ which corresponds to a maximum gas exchange valve lift. The second lift range 9*b* following the second zero lift range 9*a* also has a cam contour, i.e., the distance of the control path 9 from the axis of rotation 5*a* increases in the direction of the partial lift range 9*c* via an angle of rotation in the lift area 9*b*. The acceleration lift range 9*b*' has a degressive increase in radius, while the deceleration lift range 9*b*" has a progressive increase in radius. The partial lift range 9*c* adjacent to the deceleration lift range 9*b*" has a constant radius R3 with respect to the axis of rotation 5*a*. The difference in radius between R3 and R1 corresponds to a height $h_2$, a mean gas exchange valve lift. The acceleration lift range 9*b*' in the present example begins at a lift of 0.6 mm and extends to a lift height of 1.5 mm. The deceleration lift range 9*b*" begins above a lift height of 1.5 mm and extends to a lift height of 3.5 mm. Although the acceleration lift range 9*b*' compensates the kinematic torque of the spring element only to a minor extent and thus imposes a spring-induced acceleration on the system, the kinematic torque of the spring element 12 is overcompensated in the deceleration lift range 9*b*" and thus a spring-induced deceleration is imposed on the system via this lift range. The acceleration lift range 9*b*' and the deceleration lift range 9*b*" may assume different angular sections of the control path 9, depending on the internal combustion engine, or they may be omitted entirely and replaced by a normal cam contour.

In the diagram, the second zero lift range 9*a* is in operative connection with a roller element 10*a* of a power transmission element 10, a roller drag lever. The power transmission element 10 is supported on a play equalizing element 14, a hydraulic play equalizing element which is mounted in a stationary mount in the cylinder head 3 at one end and is supported at the other end on a valve shaft end of a gas exchange valve 2, which is held in the closed position by a valve spring 11. In addition, a stationary supporting element 13 is fixed in position on the shaft 5 with a spring element 12, a leg spring being supported on it on the one hand, while on the other hand it is also secured in position on the cylinder head 3.

During operation of the internal combustion engine, the swivel motor 4 swivels in the direction of full-lift range 7*c* at a high load demand and/or rotational speed and swivels in the direction of partial lift ranges 9*c* at a low load demand and/or rotational speed. The gas exchange valve 2 is opened with the periodic swiveling movement in one direction or the other according to the control paths 7 and/or 9. The swiveling motion of the swivel motor 4 is supported here by the spring element 12 in the opening process and the energy stored in the spring element 12 is delivered to the valve spring 11 in the opening process. In the closing process, in swiveling in the direction of the zero lift range 7*a*, 9*a*, the valve spring 11 delivers most of its stored energy to the spring element 12. Due to this spring-mass-spring oscillating system, the energy demand of the swivel motor 4 is very low, in particular at a low valve lift.

The partial lift range 9*c* arranged following that is a torque-neutral cam range in which currentless holding of the gas exchange valve 2 in the open position, at maximum partial lift, especially at low engine rotational speeds and high loads is made possible. The height $h_2$ of the partial lift range 9*c* is designed according to parameters that depend on the internal combustion engine. For the intake side of an internal combustion engine, the acceleration lift range 9*b*' of the second operating element 8 may be designed to be smaller in terms of the absolute amount than the range of the deceleration lift range 9*b*". A variability of the second control path 9 and thus a better control of the fuel mixture of the internal combustion engine can be achieved in this way. The acceleration lift range 9*b*' and the deceleration lift range 9*b*" may have the same working value for the exhaust end of an internal combustion engine to achieve the highest possible dynamics of the partial lift movement and thus expand the operating range of the partial lift operation from idling to the highest possible rotational speeds.

Due to the small variable lifts, the load control of the internal combustion engine is simpler and permits operating points in the lower load range which are more favorable from the standpoint of consumption. As an another advantage of the inventive swivel actuator device 1, the lower power consumption at low rotational speeds with small valve lifts in comparison with full valve lifts should be mentioned. Due to the small air gap at a low valve lift of the intake valve, supersonic intake velocities can be achieved, improving processing of the fuel mixture and thus reducing emissions of the internal combustion engine. A further improvement is obtained by opening the intake valve twice, a first time for intake of combustion air and a second time for creating turbulence in the combustion air with fuel. This leads to a greatly improved mixing of air and fuel and thus more uniform combustion. The opening speed of the valve movement can be reduced as desired on the exhaust end of the internal combustion engine and thus emissions by the exhaust system can be reduced. It is thus also possible to reduce the acoustic stimulation of the exhaust system and lower the total noise level of the engine.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A swivel actuator device for control of an internal combustion engine valve, comprising:

a swivel motor with a swivel shaft;

a first operating element with a first control path disposed on the swivel shaft;

a second operating element with a second control path disposed on the first operating element, wherein the first operating element and the second operating element swivel about a common axis, wherein the first control path is subdivided into at least a first zero lift range and a first lift range, and the second control path is subdivided into at least a second zero lift range and a second lift range, and wherein the first control path has a full lift range, the second control path has a partial lift range, or the first control path has a full lift range and the second control path has a partial lift range.

2. The swivel actuator device of claim 1, wherein the second zero lift range overlaps the first zero lift range.

3. The swivel actuator device of claim 1, wherein the full lift range follows the first lift range in a rotational direction of the first operating element, and the partial lift range follows the second lift range in the rotational direction of the second operating element.

4. The swivel actuator device of claim 1, wherein a lift height of the partial lift range is smaller than a lift height of the full lift range.

5. The swivel actuator device of claim 1, wherein a lift height of the full lift range is the maximum lift height of the engine valve.

6. The swivel actuator device of claim 1, wherein the second lift range is subdivided into at least an acceleration lift range and an adjacent deceleration lift range, and the acceleration lift range is adjacent to the second zero lift range.

7. The swivel actuator device of claim 6, wherein the swivel shaft swivels about a rotation axis, and a distance from the rotation axis to the second control path in the acceleration range increases degressively in the direction of the partial lift range over an angle of rotation.

8. The swivel actuator device of claim 7, wherein a distance from the rotation axis to the second control path in the deceleration range increases progressively in the direction of the partial lift range over an angle of rotation.

9. The swivel actuator device of claim 4, wherein the first operating element and the second operating element are arranged radially about a rotation axis of the swivel shaft.

10. The swivel actuator device of claim 1, wherein a power transmission element is arranged between the operating elements and the engine valve.

11. The swivel actuator device of claim 10, wherein the power transmission element is one of a drag lever, a roller drag lever and a tilt lever.

12. The swivel actuator device of claim 1, wherein the device is configured to permit operation of at least one of an engine intake valve and an engine exhaust valve.

* * * * *